US006253733B1

(12) United States Patent
Marumoto et al.

(10) Patent No.: US 6,253,733 B1
(45) Date of Patent: Jul. 3, 2001

(54) ELECTRONIC THROTTLE VALVE CONTROL APPARATUS

(75) Inventors: Katsuji Marumoto, Hitachi; Masatoshi Hoshino, Tsuchiura; Ryozo Masaki, Hitachi; Minoru Ohsuga, Hitachinaka; Mitsuru Watabe, Ibaraki-ken, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/531,763

(22) Filed: Mar. 20, 2000

Related U.S. Application Data

(63) Continuation of application No. 09/346,578, filed on Jul. 2, 1999, now Pat. No. 6,055,960.

(30) Foreign Application Priority Data

Jul. 3, 1998 (JP) ..... 10-188556

(51) Int. Cl.[7] ..... F02D 41/20
(52) U.S. Cl. ..... 123/399; 123/361
(58) Field of Search ..... 123/395, 399, 123/361

(56) References Cited

U.S. PATENT DOCUMENTS 5,396,869 * 3/1995 Suzuki et al. ..... 123/399
5,558,062 * 9/1996 De Mineo et al. ..... 123/399
5,568,797 * 10/1996 Landerretche ..... 123/399
5,602,732 * 2/1997 Nichols et al. ..... 123/399
5,749,343 * 5/1998 Nichols et al. ..... 123/399
5,755,201 * 5/1998 Knoss et al. ..... 123/399
5,927,251 * 7/1999 Watanabe et al. ..... 123/399
5,992,383 * 11/1999 Scholten et al. ..... 123/399
6,073,610 * 6/2000 Matsumoto et al. ..... 123/399

FOREIGN PATENT DOCUMENTS 6-54591 * 1/1994 (JP) .
8-303285 * 1/1996 (JP) .

* cited by examiner

*Primary Examiner*—Erick Solis
(74) *Attorney, Agent, or Firm*—Crowell & Moring, L.L.P.

(57) ABSTRACT

An apparatus of controlling an electronically controllable throttle valve for car has a sensor for detecting the opening of the throttle valve and a microcomputer. A throttle valve opening command value is delivered in the form of a digital signal under the control of the microcomputer. The digital command value signal is converted into an analog signal and on the basis of the analog signal and a detected throttle opening, a motor connected to the throttle valve is driven to control the opening thereof.

5 Claims, 11 Drawing Sheets

ELECTRONIC THROTTLE VALVE CONTROL APPARATUS

This application is a continuation of application Ser. No. 09/346,578, filed Jul. 2, 1999 now U.S. Pat. No. 6,055,960.

BACKGROUND OF THE INVENTION

The present invention relates to an electronic throttle valve control apparatus suitable for use in a car engine and more particularly to a car throttle valve control apparatus suitable for controlling a throttle valve by using a motor.

As a conventional car throttle valve control apparatus, an electronic throttle valve control apparatus has been known in which for adjustment of intake air flow sucked into an engine, a throttle valve attached to an intake manifold is controlled by a motor.

Generally, as described in, for example, JP-A-8-303285, for control of the opening of the throttle valve, the opening of the throttle valve is detected by means of, for example, a potentiometer connected directly to a rotary shaft of the throttle valve under the control of a microcomputer and the detected opening is inputted to the microcomputer through an A/D converter to perform operational control which makes the detected opening coincident with a target opening.

A technique as described in, for example, JP-A-6-54591 has also been known, according to which current flowing through a motor for rotating a throttle valve is chopper-controlled by means of, for example, an H-bridge chopper circuit comprised of power MOS FET's, the current flowing through the motor is detected and fed back to a microcomputer and a result of the feedback control operation is delivered out of the microcomputer in the form of a PWM signal to control the opening of the throttle valve.

SUMMARY OF THE INVENTION

Conventionally, for control of the throttle valve, both the opening control (position control) and the current control are effected using the microcomputer. For the purpose of improving the performance of the electronic throttle valve, the response speed of the opening control is required to be increased and to this end, a high-speed microcomputer capable of processing operations in high speed is needed. Especially, when the current control involved in a minor loop of the opening control is desired to be carried out with a microcomputer, it is inevitable that the microcomputer will be a high-speed one.

But the high-speed and high performance microcomputer is expensive, and when it is used for the electronic throttle valve, the control apparatus becomes costly as a whole and a cheap control apparatus cannot be provided.

An object of the present invention is to provide an inexpensive electronic throttle valve control apparatus in which an electronic throttle valve apparatus does not require an expensive microcomputer but uses an inexpensive microcomputer.

Another object of the present invention is to provide a throttle valve control apparatus for a car in which the accuracy of control can be improved by increasing the response speed in motor current control.

Still another object of the present invention is to provide a throttle valve control apparatus in which even when power elements of low switching speed are used in an H-bridge chopper adapted to control a motor, a response delay in switching can be compensated for.

A car electronic throttle valve control apparatus according to the present invention comprises a throttle valve, a motor for driving the throttle valve, an H-bridge chopper for chopper-controlling current flowing through the motor to control rotation of the motor, an analog current control unit for supplying a pulse-width modulation (PWM) control signal to the H-bridge chopper, a current detection unit for detecting the motor current and feed-backing it to the analog current control unit, a control unit for controlling the opening of the throttle valve by supplying a current command signal and a forward or backward rotation signal for the motor to the analog current control unit through a filter, a unit for detecting an opening of the throttle valve and feed-backing it to the opening control unit, and a unit for supplying an opening command for the throttle valve. The opening control unit responds to the opening command and the opening feedback signal to generate the current command supplied to the analog current control unit. The analog current control unit responds to the current command and the motor current feedback signal to change the PWM control signal supplied to the H-bridge chopper, so that the motor is rotated while the motor current being controlled by means of the H-bridge chopper so as to control the opening of the throttle valve.

In the car engine throttle valve control apparatus, the current control unit is an analog unit comprised of operational amplifiers and including a PWM generator circuit, a current detection circuit and a current difference operation circuit.

The PWM generator circuit may be a variable frequency type PWM circuit comprised of an integrator and a comparator.

The current detection circuit is connected to a battery current detecting resistor connected in series with the H-bridge chopper and includes an amplifier for amplifying a voltage developing across the current detection resistor and an A/D converter for converting the voltage signal into a digital signal.

The current detection circuit further includes a sample-hold circuit for sample-holding the amplified signal in synchronism with the fall of the analog PWM signal.

The throttle valve opening control unit includes a circuit which receives, under the control of a microcomputer, an opening command from a master engine control unit through a communication circuit and a feedback signal indicative of a throttle valve opening to perform a control operation and delivers a current command in the form of an analog signal through a D/A converter, or a circuit for generating a current command in the form of a duty ratio signal in the PWM mode to have control of only an opening control operation.

The throttle valve opening control unit uses an inexpensive low-speed microcomputer of slow operation processing to generate a command value of motor current and a forward or backward rotation signal for the motor, which are necessary for controlling the opening, so as to control only the throttle valve opening.

DESCRIPTION OF THE EMBODIMENTS

An embodiment of the present invention will now be described with reference to the accompanying drawings.

Figure 1:
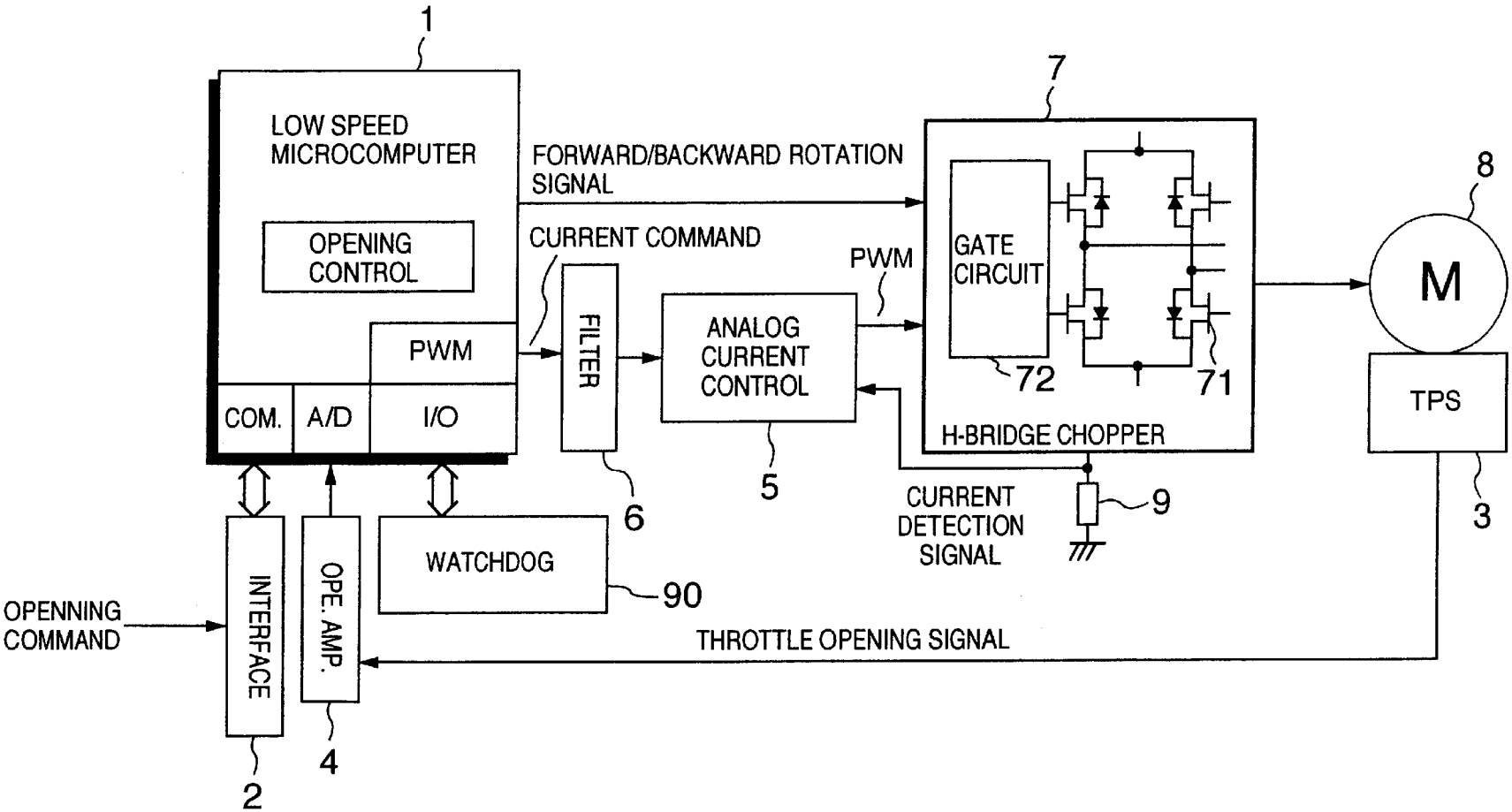
FIG. 1 is a block diagram showing the construction of a control system of an electronic throttle valve control apparatus according to an embodiment of the invention.

Referring to FIG. 1, a control system of an electronic throttle valve control apparatus according to an embodiment of the present invention is constructed as shown therein.

A command of the opening of a throttle valve attached to an intake manifold of a car engine is inputted from a master engine control unit to a microcomputer 1 through an interface 2 and a communication device. An opening of the throttle valve rotatably itself mounted to a throttle body is detected by an opening sensor (TPS) 3 connected to a rotary shaft of the throttle valve. The value of opening of the throttle valve detected by the opening sensor 3 is represented by a throttle valve opening signal, which is then amplified by an operational amplifier 4, applied to an A/D converter and converted into a digital signal by the A/D converter built in the microcomputer 1.

The microcomputer 1 performs an opening control operation on the basis of the inputted throttle valve opening command and throttle valve opening signal and delivers a current command to an analog current control unit 5 through a filter 6. The current command from the microcomputer is changed in duty ratio in the PWM mode and then delivered but alternatively, it may be delivered through a D/A converter built in the microcomputer. The microcomputer 1 also delivers a signal indicative of forward or backward rotation of a motor 8 to an H-bridge chopper 7.

The analog current control unit 5 uses the current command from the microcomputer 1 and a motor current detection signal, detected by a shunt resistor 9 and inputted as a feedback signal, so as to carry out current control. Then, a PWM signal is supplied to the H-bridge chopper 7. In the analog current control unit, feedback control is effected such that the current command from the microcomputer coincides with the detected motor current. Details of the analog current control unit will be described later with reference to FIGS. 4 and 8.

The H-bridge chopper 7 is comprised of four power MOS FET's 71 controllable in the PWM mode and functions to control the forward/backward rotation of the DC motor 8 and the current to be passed through the motor. The H-bridge chopper 7 also has a gate circuit 72 for drive of the power MOS FET's 71. The gate circuit can be driven directly by the forward/backward rotation signal from the microcomputer 1 and the PWM signal from the analog current control unit.

A watchdog timer 90 is also provided which permits normal start of the microcomputer and detection of abnormality.

Figure 2:
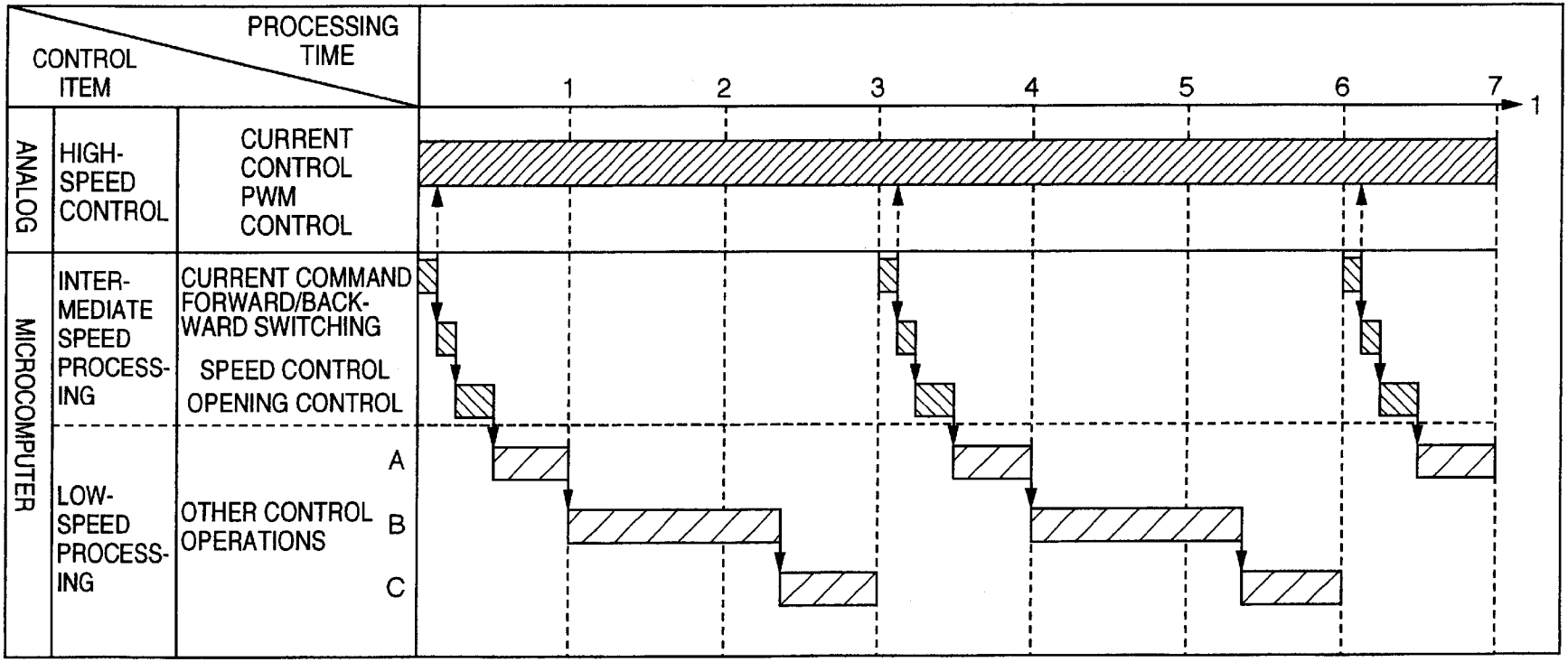
FIG. 2 is a timing chart of software process of analog control and that of microcomputer control in the embodiment of the invention.

Referring to FIG. 2, there is illustrated a time chart for the analog control and the software processing by the microcomputer. The relation between the items of control and the process timing is diagrammatically shown in the figure to indicate that the current control and PWM control operations required to be processed at a high speed are carried out in the analog control mode, the current command generation and opening control operations are processed at an intermediate speed and other control operations are processed at a low speed.

In other words, the current control operation proceeds independently and regardless of the microcomputer and only when a current command or the like is fed from the microcomputer, control can conveniently be effected such that a current conforming to the command is obtained. Thus, it suffices that the microcomputer carries out the intermediate speed processing and low speed processing, so that the current control is not loaded on the microcomputer. Accordingly, the use of a low speed microcomputer can be permitted.

The electronic throttle valve control apparatus for car using the present invention will be described in greater detail with reference to FIGS. 3 to 10.

Figure 3:
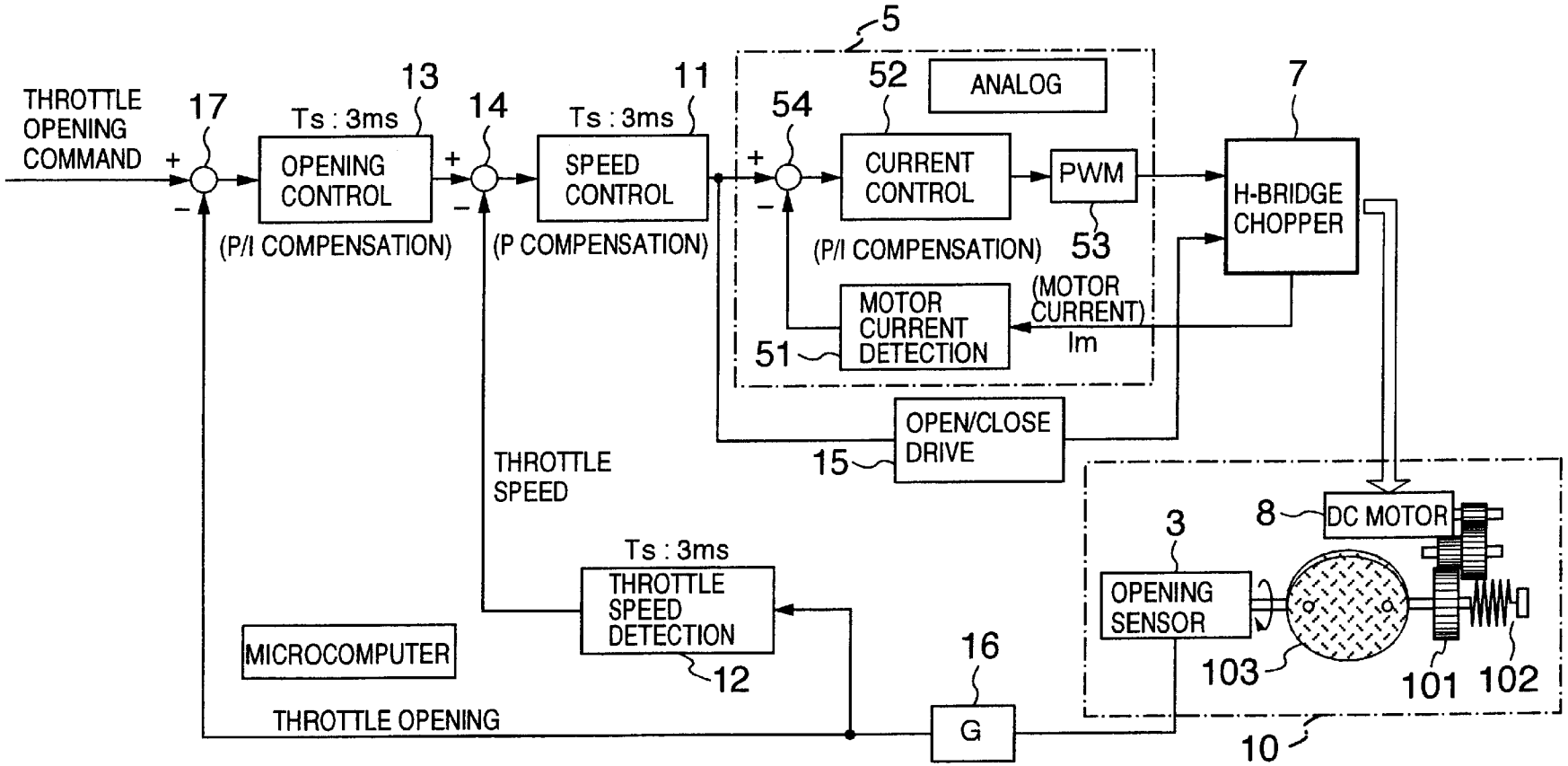
FIG. 3 is a block diagram showing control flow in the electronic throttle valve control apparatus in the embodiment of the invention.

Reference is first made to FIG. 3 showing a control block diagram of the electronic throttle valve control apparatus. The electronic throttle valve control architecture consists of three control systems, that is, current control, opening control and speed control systems. The current control system is based on analog control and the opening control and speed control systems are based on microcomputer control.

In the current control unit 5, an output value of a motor current detector 51 for detection of current flowing through the motor is compared with an output of a speed control unit 11, that is, a current command value. An analog current controller 52 performs a control operation on the basis of a comparison difference and an analog PWM circuit 53 delivers a duty ratio signal.

More particularly, in the current control unit, a current flowing through the motor 8 is detected as a voltage developing across the shunt resistor 9 connected in series with the H-bridge chopper, as described in connection with FIG. 1, and the motor current detector 51 detects an actual motor current from the voltage value. As shown in FIG. 3, the actual current value is compared with the current command value and a comparison difference is determined by means of an operation circuit 54. On the basis of the difference obtained in the difference operation circuit 54, the current controller 52 carries out a compensational operation to deliver an analog voltage, expected to be turned to a duty ratio command, to the PWM circuit 53. The PWM circuit 53 converts the analog voltage into the on/off duty ratio signal which in turn is delivered, as a PWM signal, to the H-bridge chopper 7.

The H-bridge chopper 7 responds to a valve open/close drive signal from an open/close driver 15 to be described later and the PWM signal delivered out of the PWM circuit 53 to perform a chopper operation and drives the motor 8 mounted to a throttle body 10. In addition to the motor, speed-reduction gears 101 and spring 102 for motor rotation, a throttle valve 103 for controlling the intake air flow and the valve opening sensor 3 are mounted to the throttle body 10 and as the motor rotates, the valve 103 is open/closed.

The current control system will be described later in greater detail with reference to FIG. 4 and FIGS. 8 to 10.

The second control system includes the speed control unit 11 for throttle valve. This control system functions to eliminate an overshoot in throttle valve opening control by adding to the throttle valve opening command value a correction value which takes an open/close speed of the throttle valve into consideration and to reduce time for reaching a target opening as far as possible. In this control system, there is provided a throttle speed detector 12 for detecting a speed of the valve from a change of the valve opening. A difference between the output of the detector 12 and the output of an opening control unit 13 is determined by means of a difference operation circuit 14, and the speed control unit 11 responds to the output of the circuit 14 to perform an operation for determining a current command which in turn is delivered to the current control unit 5. At the same time, a signal indicative of a rotation direction of the motor 8 is derived from the operation result determined by the speed control unit 11 and delivered to the open/close driver 15.

The last one of the control system is the throttle opening (position) control system. In this control system, a comparison operation circuit 17 compares a throttle opening command inputted from the engine control unit of car, not shown, with an actual throttle valve opening obtained by amplifying an opening signal of the opening sensor 3 built in the throttle body 10 by means of an amplifier 16, thus determining a difference.

The difference signal is inputted to the opening control unit 13. In the opening control unit, a proportional/integral (P, I) compensational operation is carried out to effect feedback control which makes the actual throttle opening coincident with the throttle opening command.

In the above electronic throttle valve control, the motor current control system required to have a high control response is in the analog control mode and the throttle valve opening control and speed control systems in which operation can proceed slower than that in the current control system are in the microcomputer control mode. In this case, the operation process by the microcomputer can be effected, for example, every 3 ms (milliseconds) to reduce the load ratio on the microcomputer, thereby permitting the use of an inexpensive low-speed microcomputer.

Figure 4:
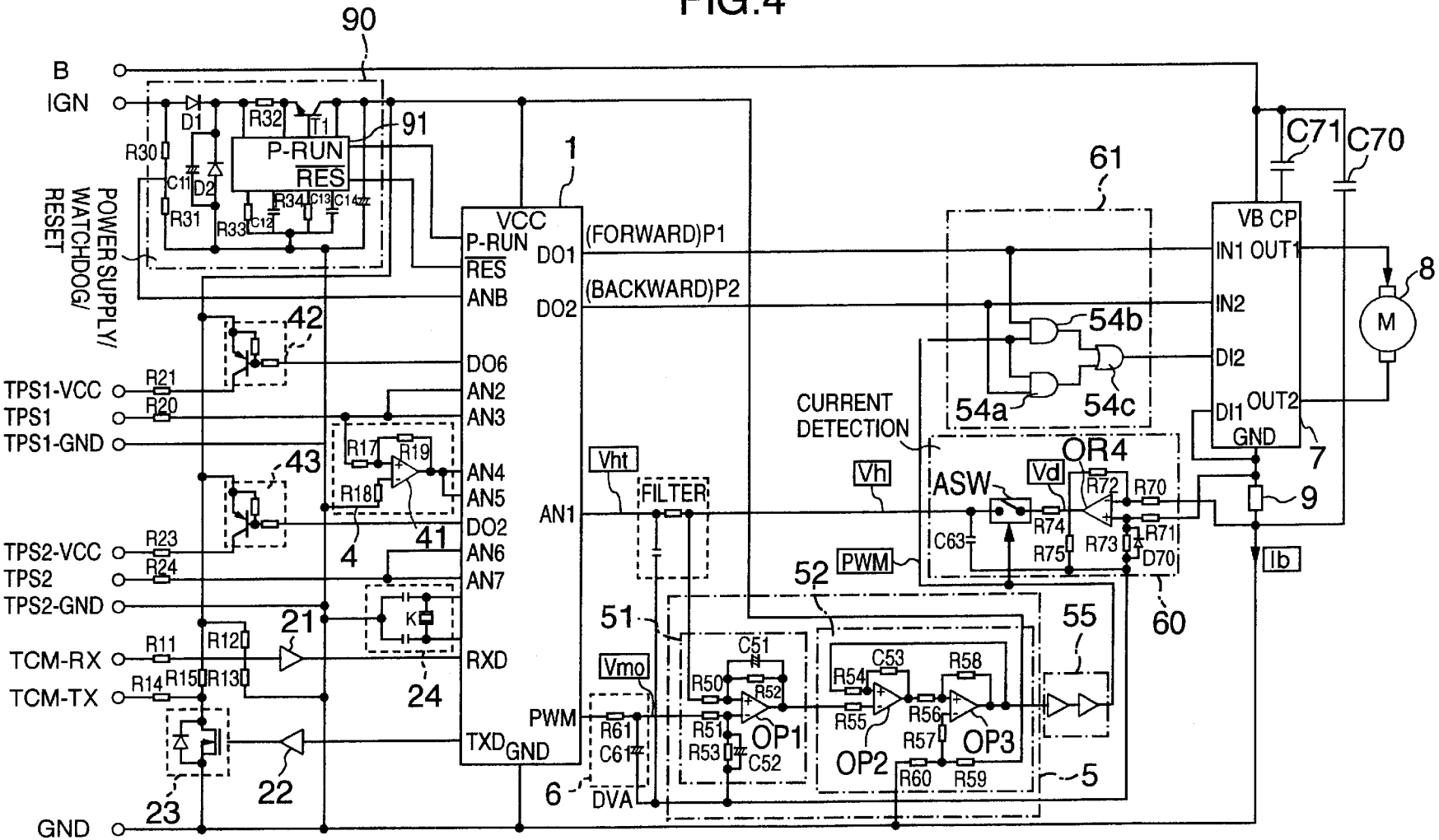
FIG. 4 is a diagram showing details of the hardware construction of the electronic throttle valve control apparatus in the embodiment of the invention.
Figure 5:
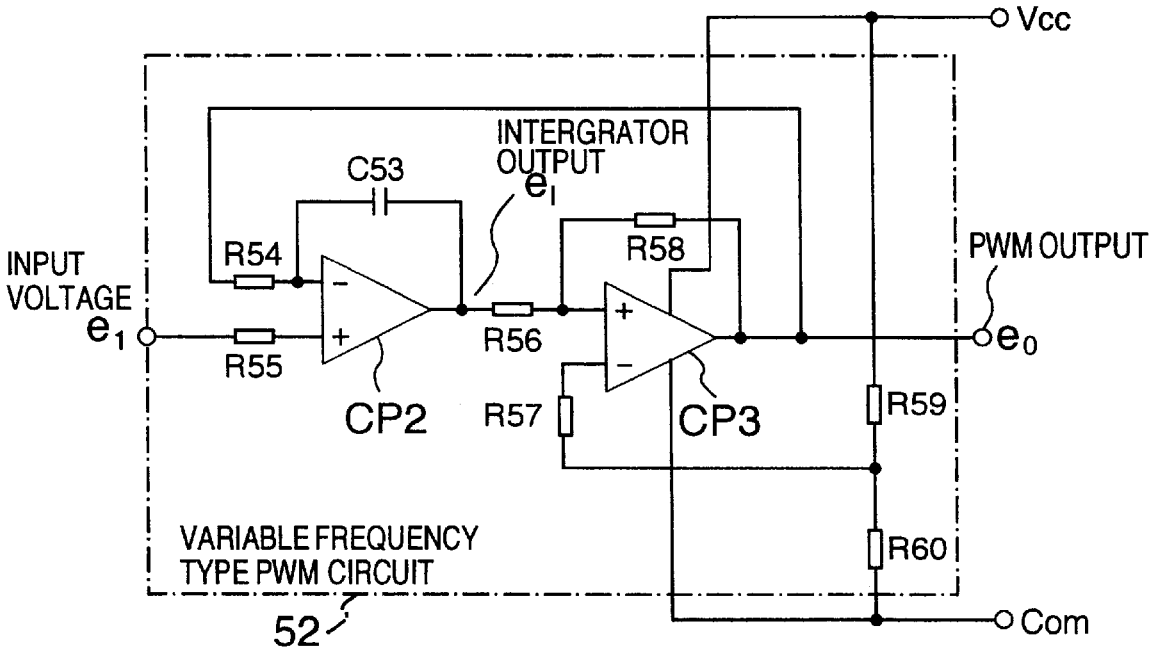
FIG. 5 is a circuit diagram of a variable frequency type PWM control circuit of the electronic throttle valve control apparatus in the embodiment of the invention.

Referring now to FIG. 4, detailed hardware of the control system constructed as shown in FIG. 1 is illustrated. The microcomputer 1 has a receiving terminal RXD and an opening signal supplied from the master engine control unit to a TCM-RX terminal is inputted to the receiving terminal RXD through an interface comprised of resistors R11 to R13 and a buffer 21. Interchange of an accelerator opening signal is carried out in the bidirectional communication mode between a TXD terminal of the microcomputer and the control unit through an interface comprised of a buffer 22, resistors R14 and R15 and a power MOS FET 23 as well as a TCM-TX terminal.

On the other hand, an actual throttle valve opening represented by a signal from the opening sensor 3 applied to a terminal TPS1 is amplified by the operational amplifier 4 comprised of an amplifier 41 and resistors R17 to R19 and inputted to the A/D converter inside the microcomputer through input terminals AN4 and AN5.

The opening signal of the throttle valve is duplicative from the standpoint of safety or security and therefore, the signal also applied to a terminal TPS2 is taken into the microcomputer. Transistors 42 and 43 connected to terminals TPS1-VCC and TPS2-VCC on the power supply side are operated as switches so as to be used for checking the sensor for disconnection. A circuit designated by 24 is a generator of the clock necessary for operation of the microcomputer.

The power supply circuit 90 has the watchdog function and is comprised of a power supply IC 91, resistors R30 to R34, capacitors C11 to C14, a transistor T1 and diodes D1 and D2. This circuit performs the function of power supply, watchdog and resetting, so that program start and reset operation in the microcomputer 1 are effected by the power supply circuit 90.

Next, the construction of the analog current control unit will be described. The analog current control unit 5 has circuitry as shown in FIG. 4. The current control unit 5 includes a differential amplifier 51 and a variable frequency type PWM circuit 52. The differential amplifier 51 is comprised of an operational amplifier OP1, input resistors R50 and R51, feedback resistors R52 and R53 and compensational capacitors C51 and C52. The current command from the microcomputer 1, converted into a duty ratio signal, is smoothed by a filter 6 comprised of a resistor R61 and a capacitor C61 to produce a smoothed signal Vmc and the signal Vmc is inputted to a positive terminal (+) of the operational amplifier OP1 of differential amplifier 51 through the input resistor R51. On the other hand, a feedback signal, obtained by detecting a voltage developing across the shunt resistor 9 owing to a battery current Ib by means of a current detector circuit 60, is inputted to the other (−) terminal of the operational amplifier OP1 of differential amplifier 51 through the input resistor R50, causing the operational amplifier OP1 to deliver an analog signal which makes the detection current coincident with the current command value.

Next, the variable frequency type PWM circuit 52 will be described. In the circuit 52, an operational amplifier OP2 is connected with input resistors R54 and R55 and a feedback capacitor C53 to constitute an integrator. The other operational amplifier OP3 is connected with input resistors R56 and R57 and a feedback resistor R58 to constitute a comparator having hysteresis. Resistors R59 and R60 are adapted to set the operating point voltage of the comparator.

The independent integrator and comparator as above are connected to each other by connecting the output of the integrator to the input of the comparator as shown in FIG. 4 while feed-backing the output of the comparator to the input of the integrator, thereby realizing a variable frequency type PWM oscillator circuit.

Figure 6:
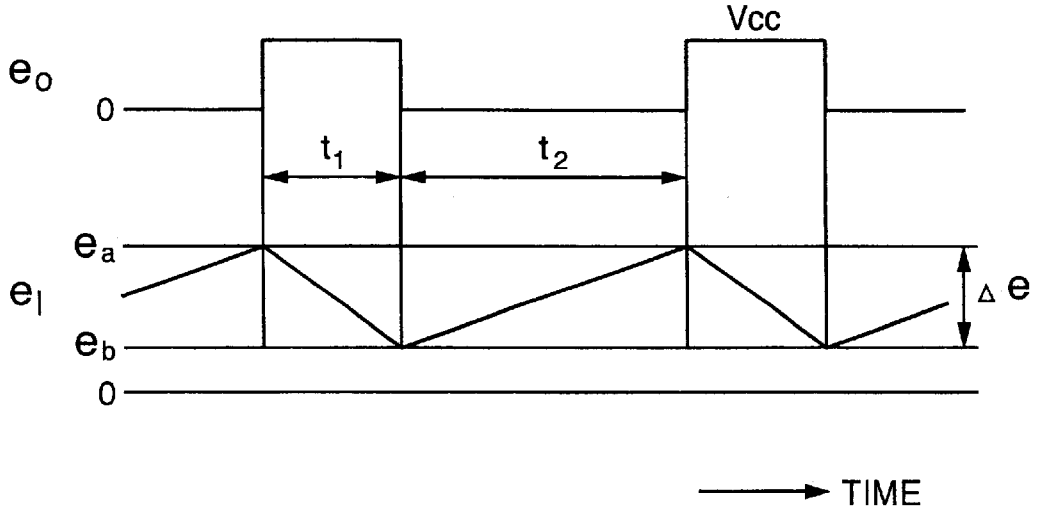
FIG. 6 is a time chart for explaining the operational principle of the variable frequency type PWM control circuit of the electronic throttle valve control apparatus in the embodiment of the invention.
Figure 7A:
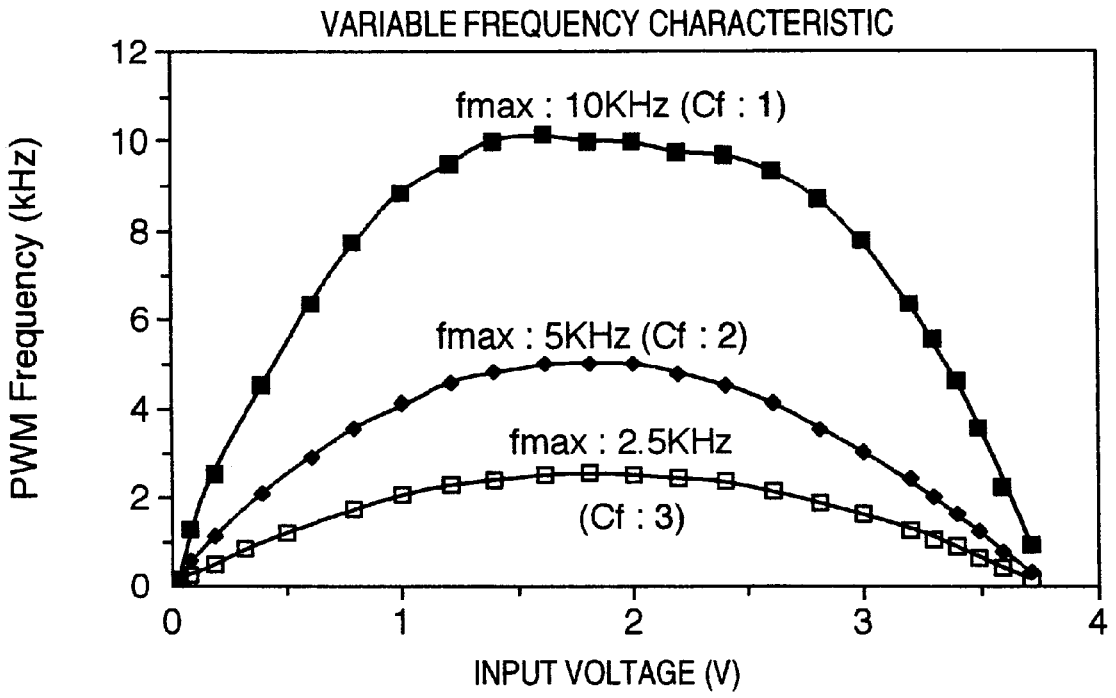
FIGS. 7A and 7B are graphs showing operational characteristics of the variable frequency type PWM control circuit of the electronic throttle valve control apparatus in the embodiment of the invention.
Figure 7B:
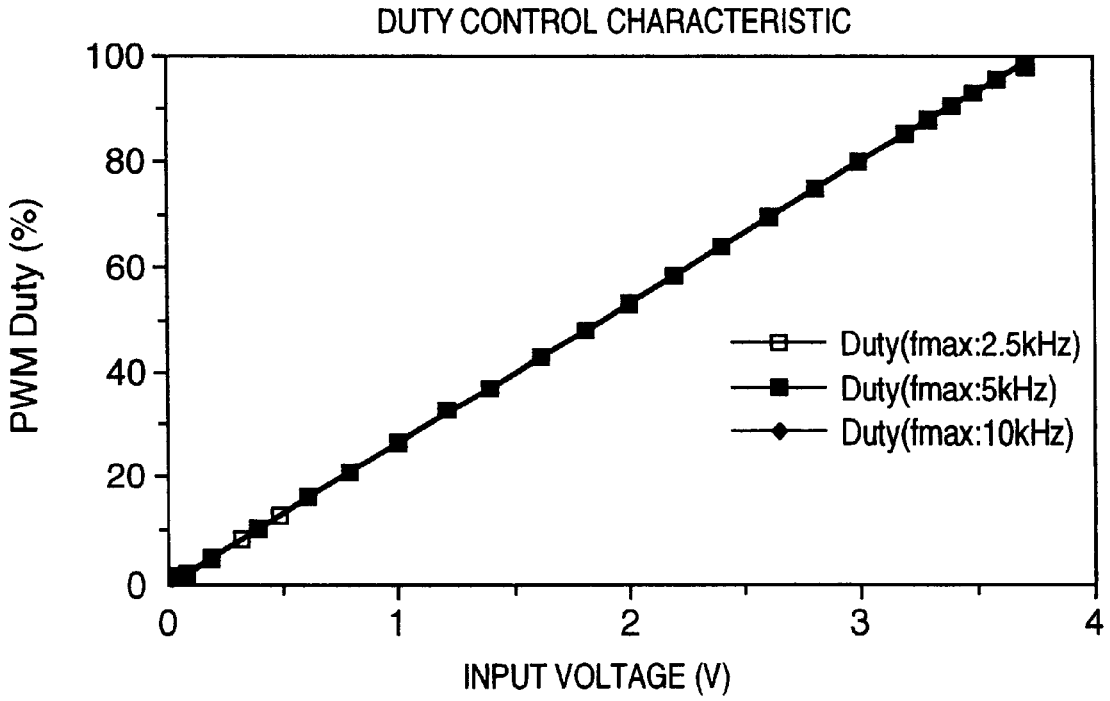
Figure 8A:
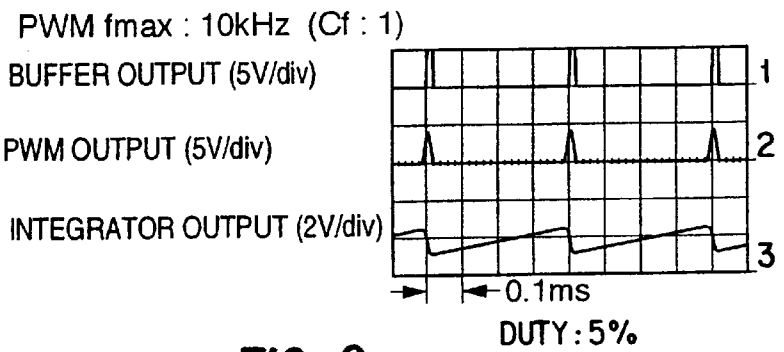
FIG. 8 shows time charts for explaining the operation of the variable frequency type PWM control circuit of the electronic throttle valve control apparatus in the embodiment of the invention.
Figure 8B:
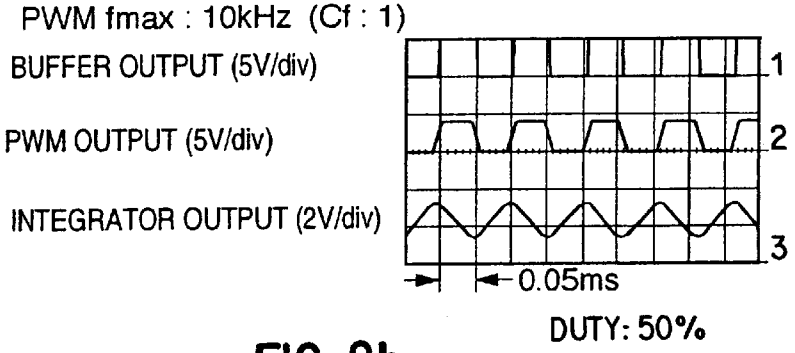
Figure 8D:
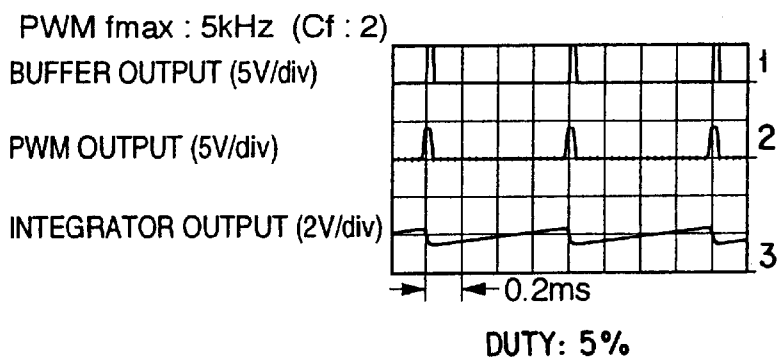
Figure 8E:
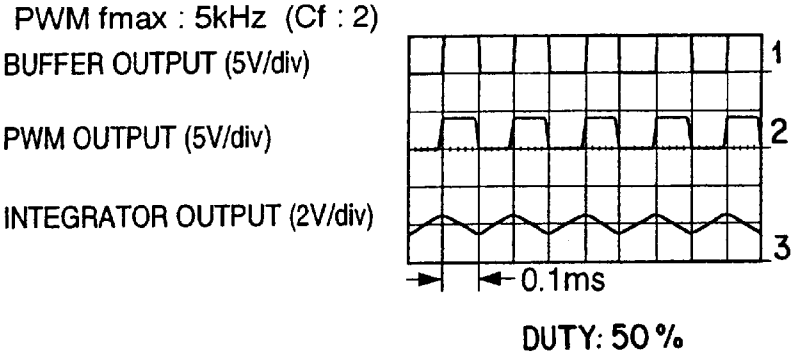
Figure 8C:
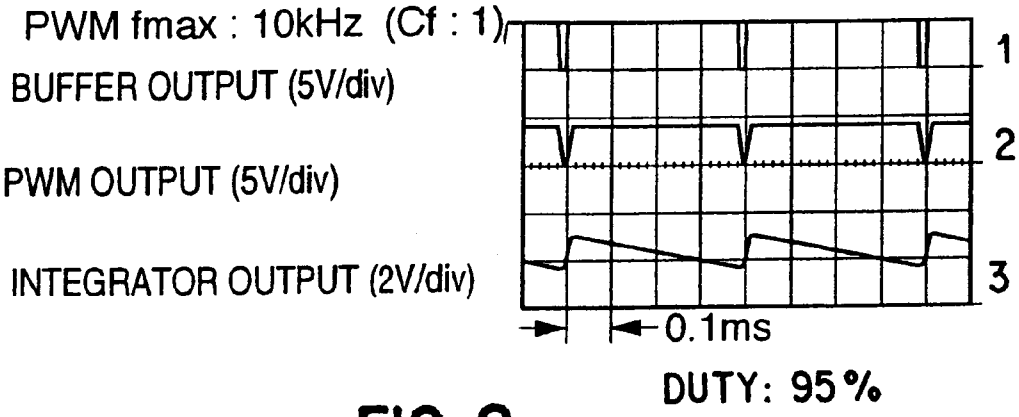
Figure 8F:
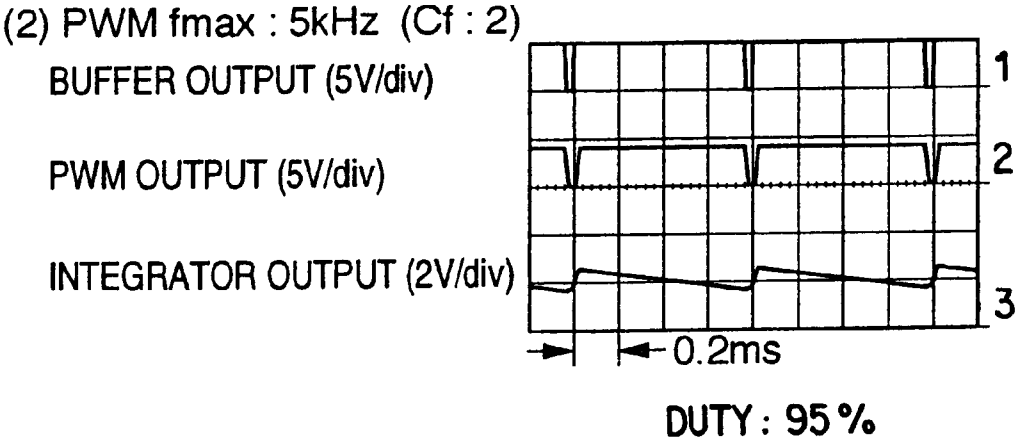
Figure 8G:
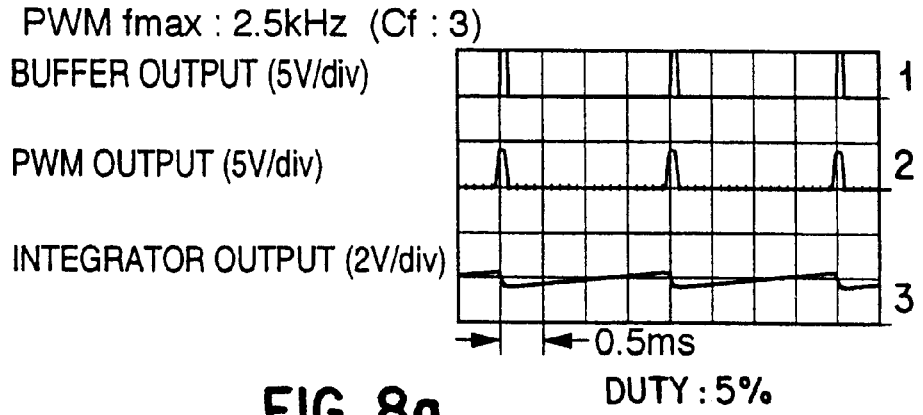
Figure 8H:
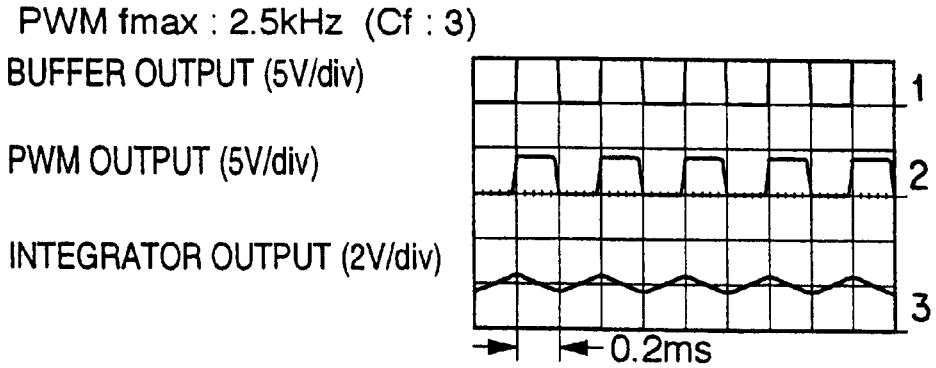
Figure 8I:
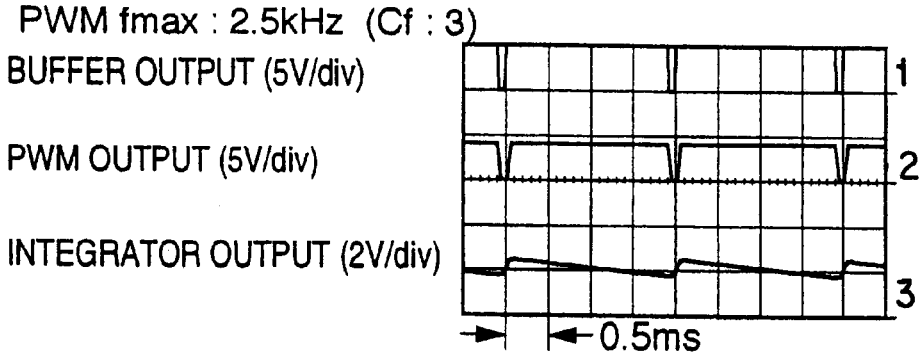

The variable frequency type PWM circuit will be described in greater detail with reference to FIGS. 5 to 8. The variable frequency type PWM circuit shown in FIG. 5 operates as will be detailed below. A fundamental operational waveform in the PWM mode is shown in FIG. 6. Where input voltage is e1 and comparator output is e0, integrator output eI is given by equation (1):

$$e_I=-(e_1-e_0)\cdot t \tag{1}$$

As the comparator output $e_0$ takes a value of $e_0$=Vcc, the integrator output $e_I$ decreases. Consequently, on the assumption that time $t_1$ is required for voltage to decrease from $e_a$ to $e_b$, the $t_1$ is determined from equation (1) as follows:

$$t_1=\Delta e/Vcc-e_1 \quad (2)$$

where $\Delta e$ equals $e_a-e_b$ and $e_1$ reaches $e_b$, the comparator output $e_0$ equals to zero. As a result, the input to the integrator is only e1 and $e_I$ increases. On the assumption that time required for $e_I$ to reach $e_a$ is $t_2$, the following equation is obtained:

$$t_2=\Delta e/e_1 \quad (3)$$

As will be seen from the above, the comparator output $e_0$ takes a square wave signal having a value of Vcc during $t_1$ and a value of 0 during $t_2$. Where the square wave has conduction ratio $\alpha$ and frequency f, the $\alpha$ and f are defined and reduced equations (4) and (5), respectively, in accordance with equations (2) and (3):

$$\alpha=t_1/t_1+t_2=\Delta e/Vcc-e_1/\Delta e/(Vcc-e_1)+\Delta e/e_1=e_1/Vcc \quad (4)$$

$$f=1/t_1+t_2=1/\Delta e/(Vcc-e_1)+\Delta e/e_1=(Vcc-e_1)e_1/\Delta e\cdot Vcc \quad (5)$$

By substituting equation (4) into equation (5) and eliminating $e_1$, equation (6) is obtained:

$$f=Vcc\cdot\alpha(1-\alpha)/\Delta e \quad 6)$$

As will be seen from equation (4), the conduction ratio $\alpha$ is proportional to $e_1$ when Vcc is constant. From equation (6), the frequency f is represented by a square function of $\alpha$ when $\Delta e$ is constant.

Namely, the variable frequency type PWM circuit can be realized which can control the PWM conduction ratio $\alpha$ in proportion to the control input voltage and the frequency f in relation of square function to the conduction ratio by using simple circuitry of the integrator and the comparator.

Variable frequency characteristics and duty ratio characteristics of the variable frequency type PWM circuit described above are illustrated in FIGS. 7A and 7B, respectively. Operational waveforms of the variable frequency type PWM circuit are illustrated in FIG. 8. In each of the FIGS. 7A and 7B and FIG. 8, data are given for maximum frequencies of about 10 kHz, 5 kHz and 2.5 kHz. The frequency characteristic assumes a maximum frequency near a PWM duty ratio of 50% and as the duty ratio increases or decreases, the frequency decreases, demonstrating that the frequency characteristic indicates a characteristic of square function. The duty ratio characteristic has good linearity and is controllable in a wide range of 0 to 100%.

Thus, the variable frequency control can be effected while permitting the duty ratio to be controllable in good linearity, so that even when an element of slow swing speed is used as the power MOS FET for drive of the motor as will be described later, the PWM control range can be extended sufficiently.

Accordingly, the present system is proven to be effective for the case where the H-bridge chopper especially for use in the electronic throttle valve control apparatus is driven with high frequencies.

Reverting to FIG. 4, the current detection circuit 60 and a gate logic 61 will be described. In the current detection circuit 60, an operational amplifier OP4 connected with input resistors R70 and R71 and output resistors R72 and R73 is used to amplify a detected voltage developing across the shunt resistor 9 owing to a battery current flowing through the H-bridge chopper. The battery current is an intermittent current synchronous with the PWM as will be seen from FIGS. 9 and 10.

Accordingly, the battery current is unsuitable for use as a feedback signal for current control. Then, in the current detection circuit shown in FIG. 4, an analog switch ASW and a capacitor C53 are used to constitute a sample-hold circuit with the aim of eliminating the intermittency of the detected voltage. More particularly, the voltage is held on the capacitor during off-period of the battery current detection value in synchronism with the PWM signal delivered through a buffer 55. As a result, the intermittent battery current can simulate continuous motor current.

The logic circuit 61 is comprised of AND gates 54*a* and 54*b* and an OR gate 54*c* and it responds to the forward and backward rotation signals for the motor from the microcomputer and the PWM signal to supply the switching signals and PWM signal to the H-bridge chopper 7, thus driving the motor 8. Capacitors C70 and C71 connected to the H-bridge chopper are filter capacitors.

Figure 9:
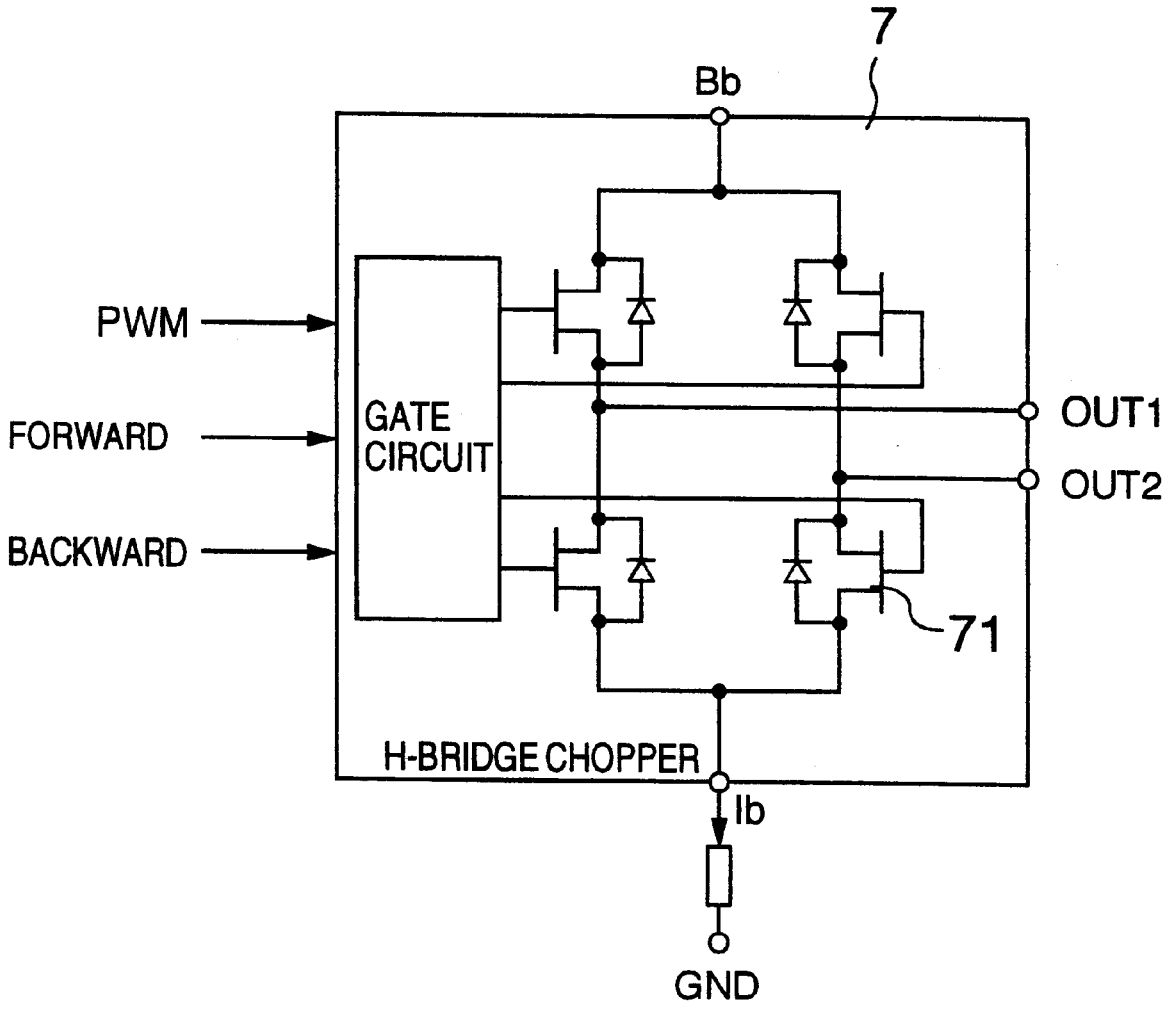
FIG. 9 is a circuit diagram of an H-bridge chopper of the electronic throttle valve control apparatus in the embodiment of the invention.
Figure 10:
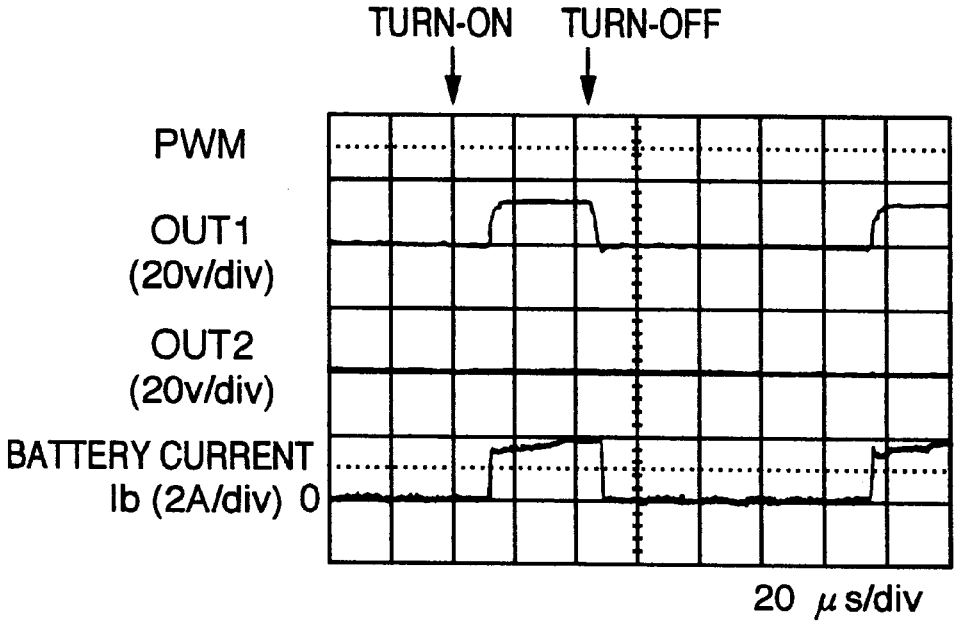
FIG. 10 is a time chart for explaining the operation of the H-bridge chopper of the electronic throttle valve control apparatus in the embodiment of the invention.

Referring to FIG. 9, there is illustrated a circuit diagram of the H-bridge chopper 7. In the chopper circuit using power elements, actual current is delayed with respect to the PWM signal during turn-on and turn-off operations as shown in FIG. 10 and a non-control range takes place. The higher the PWM frequency, the more this influence becomes remarkable. To cope with this problem, the variable frequency type PWM circuit of the present invention can be used conveniently. More particularly, the problem can be solved by the variable frequency type PWM circuit in which the PWM frequency can be decreased in case of either small duty ratio PWM or large duty ratio PWM greatly affected by the turn-on and turn-off delay.

Figure 11:
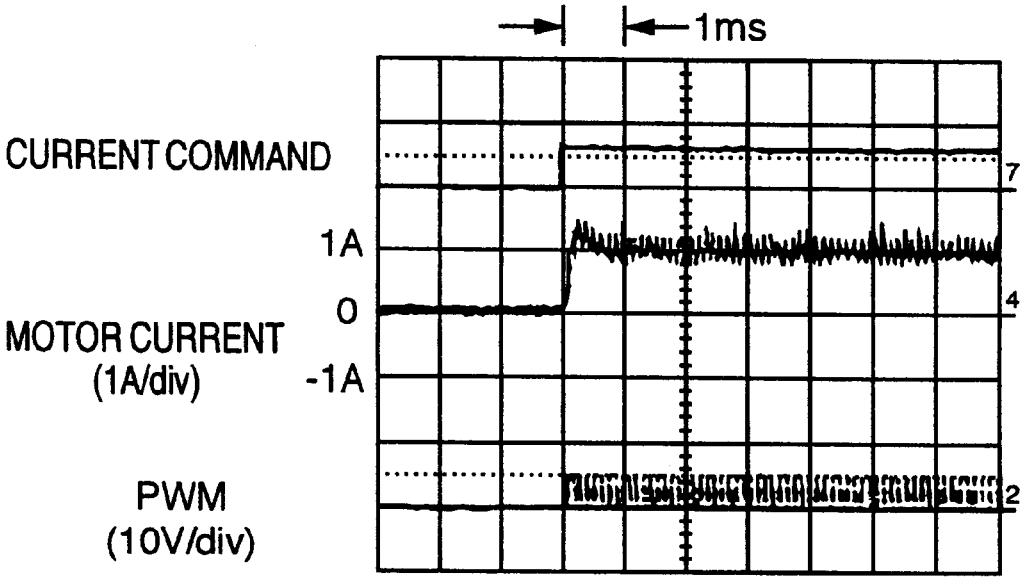
FIG. 11 is a graph showing step response characteristics of current control in the electronic throttle valve control apparatus in the embodiment of the invention.

Referring to FIG. 11, there is illustrated a step response waveform of the motor current in the electronic throttle valve of the invention using the microcomputer and the analog mode. As will be seen from the figure, high speed response can advantageously be ensured by the analog type current control.

As described above, in the electronic throttle valve control apparatus for use in the car engine according to the foregoing embodiment of the invention, the inexpensive microcomputer of slow operation speed can be used and hence the control apparatus can be reduced in cost. Further advantages can be attained, including improvements in control accuracy thanks to high-speed response to the motor current, enlargement of the control range due to variable frequency, reduction of electromagnetic sounds, caused by motor ripple current, thanks to high chopper frequency and inexpensiveness of the control unit thanks to great reduction of print circuit board wiring due to simple hardware of the analog current control unit.

What is claimed is:

1. An electronic throttle valve control apparatus for an internal combustion engine comprising:

a microcomputer which is supplied with a throttle valve opening command from an engine control unit;

a motor driver circuit which receives a motor current control command calculated by said microcomputer;

a motor driven by an output of said motor driver circuit;

a current feedback control circuit which feedback-controls a current flowing through said motor; and an opening feedback control circuit which feedback-controls an opening of said throttle valve;

wherein said microcomputer controls said current feedback control circuit and said opening feedback control circuit such that current feedback control is processed faster than the opening feedback control.

2. An apparatus according to claim 1, further comprising a current detection resistor which detects a current flowing in said motor.

3. An apparatus according to claim 1, wherein said motor driver circuit includes an H-bridge circuit.

4. An apparatus according to claim 2, wherein said motor driver circuit includes an H-bridge circuit.

5. An apparatus according to claim 2, further comprising a throttle opening sensor for detecting opening degree of the throttle valve, wherein an output of said throttle opening sensor is input to said microcomputer and an output of said current detection resistor is input to said microcomputer.

* * * * *